US006805134B2

(12) United States Patent
Peele

(10) Patent No.: US 6,805,134 B2
(45) Date of Patent: Oct. 19, 2004

(54) TOBACCO PROCESSING

(75) Inventor: David McCray Peele, Edenton, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 0 days.

(21) Appl. No.: 09/735,177

(22) Filed: Dec. 12, 2000

(65) Prior Publication Data

US 2001/0000386 A1 Apr. 26, 2001

Related U.S. Application Data

(63) Continuation of application No. 09/299,403, filed on Apr. 26, 1999, now abandoned.

(51) Int. Cl.[7] ..... A24B 1/02
(52) U.S. Cl. ..... 131/299; 131/290; 432/500
(58) Field of Search ..... 131/290, 299, 131/300, 302, 303; 432/500; 426/520, 521

(56) References Cited

U.S. PATENT DOCUMENTS

| | | | | |
|---|---|---|---|---|
| 514,370 | A | 2/1894 | Knott et al. | |
| 1,017,713 | A | 2/1912 | Vaughan | |
| 1,543,245 | A | 6/1925 | Buensod | |
| 1,545,811 | A | 7/1925 | Buensod | |
| 1,568,316 | A | 1/1926 | Buensod | |
| 2,124,012 | A | 7/1938 | Smith, Jr. | 34/24 |
| 2,343,345 | A | 3/1944 | Touton | 131/140 |
| 2,475,568 | A | 7/1949 | Moore, Jr. | 131/140 |
| 2,758,603 | A | 8/1956 | Heljo | 131/121 |
| 2,989,057 | A | 6/1961 | Touton | 131/140 |
| 3,024,792 | A | 3/1962 | Touton | 131/140 |
| 3,039,475 | A | 6/1962 | Prilly et al. | 131/140 |
| 3,134,583 | A | 5/1964 | Wilson | 263/19 |
| 3,202,157 | A | 8/1965 | Touton | 131/134 |
| 3,251,620 | A | 5/1966 | Hassler | 294/5.5 |
| 3,394,709 | A | 7/1968 | Remer | 131/121 |
| 3,494,723 | A | 2/1970 | Gray | 21/54 |
| 3,494,724 | A | 2/1970 | Gray | 21/54 |
| 3,503,137 | A | 3/1970 | Wilson | 34/45 |
| 3,664,034 | A | 5/1972 | Wilson | 34/225 |
| 3,669,429 | A | 6/1972 | Dew | 263/19 D |
| 3,699,976 | A | 10/1972 | Abe et al. | 131/121 |
| 3,773,055 | A | 11/1973 | Stungis et al. | 131/140 P |
| 3,785,384 | A | 1/1974 | Sylvester et al. | 131/121 |
| 3,845,774 | A | 11/1974 | Tso et al. | 131/140 C |
| 3,870,053 | A | 3/1975 | Heitkamp et al. | 131/121 |
| 3,877,468 | A | 4/1975 | Lichtneckert et al. | 131/2 |
| 3,901,248 | A | 8/1975 | Lichtenckert et al. | 131/2 |
| 3,937,227 | A | 2/1976 | Azumano | |
| 4,011,041 | A | 3/1977 | Taylor | 432/21 |
| 4,021,928 | A | 5/1977 | Johnson | 34/38 |
| 4,114,288 | A | 9/1978 | Fowler | |
| 4,192,323 | A | 3/1980 | Horne | |
| 4,206,554 | A | 6/1980 | Fowler | 34/34 |
| 4,212,634 | A | 7/1980 | Mitchell et al. | 432/186 |
| 4,247,992 | A | 2/1981 | MacGregor | |
| 4,267,645 | A | 5/1981 | Hill | 34/213 |
| 4,301,817 | A | 11/1981 | Keritsis | 131/297 |
| 4,317,837 | A | 3/1982 | Kehoe et al. | 426/3 |
| 4,355,648 | A | 10/1982 | Bokelman et al. | 131/290 |
| 4,364,401 | A | 12/1982 | Keritsis | 131/297 |
| 4,424,024 | A | 1/1984 | Wilson et al. | |
| 4,430,806 | A | 2/1984 | Hopkins | 34/1 |
| 4,470,422 | A | 9/1984 | Joubert et al. | 131/303 |
| 4,482,315 | A | 11/1984 | Day | 432/189 |
| 4,499,911 | A | 2/1985 | Johnson | 131/302 |
| 4,556,073 | A | 12/1985 | Gravely et al. | 131/297 |
| 4,557,280 | A | 12/1985 | Gravely et al. | 131/297 |
| 4,559,956 | A | 12/1985 | De Lange et al. | 131/303 |
| 4,566,469 | A | 1/1986 | Semp et al. | 131/308 |
| 4,572,219 | A | 2/1986 | Gaisch et al. | 131/308 |
| 4,590,954 | A | 5/1986 | Gooden | 131/299 |
| 4,620,556 | A | 11/1986 | Rosson et al. | 131/313 |
| 4,622,982 | A | 11/1986 | Gaisch et al. | 131/297 |
| 4,651,759 | A | 3/1987 | Uydess | 131/297 |
| 4,685,478 | A | 8/1987 | Malik et al. | 131/297 |
| 4,709,710 | A | 12/1987 | Gaisch et al. | 131/308 |
| 4,756,317 | A | 7/1988 | Edwards | 131/299 |
| 4,790,335 | A | 12/1988 | Marley et al. | 131/304 |
| 4,802,498 | A | 2/1989 | Ogren | 131/359 |
| 4,805,642 | A | 2/1989 | Rainer | 131/297 |

(List continued on next page.)

FOREIGN PATENT DOCUMENTS

| | | | |
|---|---|---|---|
| CA | 1026186 | 2/1978 | |
| DE | 1767677 | 11/1971 | A24B/15/02 |
| DE | 39014169 A1 | 8/1990 | A01N/65/00 |
| GB | 706 052 | 3/1954 | |
| GB | 1 484 663 | 9/1977 | A24B/15/00 |
| GB | 2 064 294 | 6/1981 | A24B/15/32 |
| GR | 862434 | 10/1986 | |
| WO | 94/07382 | 4/1994 | A24B/15/24 |
| WO | WO 98/05226 | 2/1998 | |
| WO | WO 98/58555 | 12/1998 | |
| WO | WO 00/15056 | 3/2000 | |

OTHER PUBLICATIONS

Stehlik, G. et al., Ecotoxicology and Environmental Safety 6, pp. 495–500 (1982).
Scanian, R.A., et al., American Chemical Society, Chapter 3, (1994).
IARC Monograph, vol. 17, pp. 35–47 (1978).
Chamberlain, W.J., et al., Beitr. Tabak., vol. 15, No. 2, pp. 87–92 (1992).

(List continued on next page.)

*Primary Examiner*—Dionne A. Walls
(74) *Attorney, Agent, or Firm*—Piper Rudnick LLP; Steven B. Kelber

(57) ABSTRACT

Tobaccos are cured in a manner so as to provide tobaccos having extremely low tobacco specific nitrosamine (TSNA) contents. Harvested Virginia tobacco is subjected to flue-curing so as to provide flue-cured tobacco. During the curing processing steps, contact of the tobacco with nitric oxide gases, such as those produced as combustion products of propane burning heating units, is avoided. Tobacco in curing barns is not subjected to direct-fire curing techniques, but rather, heat for tobacco curing can be provided by heat exchange or electrical heating methods.

4 Claims, No Drawings

U.S. PATENT DOCUMENTS

| | | | | |
|---|---|---|---|---|
| 4,821,747 | A | 4/1989 | Stuhl et al. | 131/299 |
| 4,836,222 | A | 6/1989 | Livingston | 131/310 |
| 4,874,000 | A | 10/1989 | Tamol et al. | 131/375 |
| 4,898,189 | A | 2/1990 | Wochnowski | 131/299 |
| 4,906,274 | A | 3/1990 | Mattox | 71/67 |
| 4,907,605 | A | 3/1990 | Ray et al. | 131/270 |
| 5,018,281 | A | 5/1991 | Bulluck, Jr. | 34/35 |
| 5,023,376 | A | 6/1991 | Shehad et al. | 564/298 |
| 5,125,420 | A | 6/1992 | Livingston | 131/302 |
| 5,127,934 | A | 7/1992 | Mattox | 71/67 |
| 5,139,035 | A | 8/1992 | Lasch et al. | 131/299 |
| 5,335,590 | A | 8/1994 | Crump, III et al. | 99/479 |
| 5,372,149 | A | 12/1994 | Roth et al. | 131/300 |
| 5,431,175 | A | 7/1995 | Beckett et al. | 131/303 |
| 5,488,962 | A | 2/1996 | Perfetti | 131/270 |
| 5,515,775 | A | 5/1996 | Crump, III et al. | 99/479 |
| 5,685,710 | A | 11/1997 | Martinez Sagrera et al. | |
| 5,791,353 | A | 8/1998 | Jünemann et al. | 131/297 |
| 5,803,081 | A | 9/1998 | O'Donnell, Jr. et al. | 131/299 |
| 5,803,801 | A | 9/1998 | Vrijsen | |
| 5,810,020 | A | 9/1998 | Northway et al. | |
| 6,202,649 | B1 | 3/2001 | Williams | 131/303 |

OTHER PUBLICATIONS

Alphin, J. G. "Measuring Airflow Characteristics of Tobacco Bulk Curing Structures" Presented at the Winter Meeting of the American Society of Agricultural Engineers (1985).

Andersen et al.; "Changes in Chemical Composition of Homogenized Low–Cured and Air–Cured Burley Tobacco Stored in Controlled Environments" *J. Agric. Food Chem.,* 30 663–668 (1982).

Bridges et al., "A Deep–Layer Drying Model for Burley Tobacco Curing" *Transactions of the ASAE* 1608–1612 (1981).

Burton et al.; "Influence of Temperature and Humidity on the Accumulation of Tobacco–Specific Nitrosamines in Stored Burley Tobacco" *J. Agric. Food Chem.* 37 1372–1377 (1989).

Burton et al. "Changes in Chemical Composition of Burley Tobacco during Senescence and Curing. 3. Tobacco–Specific Nitrosamines" *J. Agric. Food Chem.* 37:426–430 (1989).

Chamberlain et al.; "Studies on the Reduction of Nitrosamines in Tobacco" *Tobacco Science* 81 38–39 (1986).

Chamberlain et al.; "Effects of Curing and Fertilization on Nitrosamine Formation in Bright and Burley Tobacco" *Beiträge zur Tabakiorschung International* 15:2 87–92 (1992).

Chamberlain et al.; "Levels of N–Nitrosonornicotine in Tobaccos Grown Under Varying Agronomic Conditions" *Tobacco Science* 156–158 (1984).

Chang, C. S. and W. H. Johnson "High Temperature Convective Drying or Tobacco During Curing: I. Effect of Air Temperature and Velocity on Leaf Temperature and Drying Rate" *Tobacco Science* 15:23–28 (1971).

Chang, C. S. and W. H. Johnson "High Temperature Convective Drying or Tobacco During Curing II. Effect of Air Temperature and Velocity on Heat and Mass Transfer Coefficients" *Tobacco Science* 16:61–64 (1972).

Condiff, et al. "A Solar System for Curing Tobacco in Conventional Forced Air Barns" Presented at the Winter Meeting of the American Society of Agricultural Engineers (1979).

Coresta; "The Nicotiana Catalogue—A Compilation of International Tobacco Germplasm Holdings" (1998 Prototype).

Coresta Agronomy & Phytopathology Joint Meeting; "Abstracts" (1995).

Coresta; "Report of Research Activities of Mr. Q Qungang," Department of Tobacco Science—Henan Agricultural University, Zhengzhou City, Henan Province PRC (1988).

Cui et al.; "Effect of Maleic Hydrazide Application on Accumulation of Tobacco–Specific Nitrosamines in Air–Cured Burley Tobacco" *J. Agric. Food Chem.* 42 2912–2916 (1994).

*Curing Flue–Cured Tobacco in Canada* Agriculture Canada (1987).

Defendant R.J. Reynolds Tobacco Company's Amended And Supplemental Responses To Plaintiff's First Set Of Interrogatories; *Star Scientific, Inc. v. R.J. Reynolds Tobacco Company* AW 01 CV 1504 (2002).

Declaration of G. Brent Hunter; *Star Scientific, Inc. v. R.J. Reynonds Tobacco Company* AW 01 CV 1504 (Feb. 22, 2002).

Declaration of Samuel Thomas; *Star Scientific, Inc. v. R.J. Reynolds Tobacco Company* AW 01 CV 1504 (2002).

Declaration of John E. Ashe, Jr.; *Star Scientific, Inc. v. R.J. Reynolds Tobacco Company* AW 01 CV 1504 (2002).

Declaration of A. Wade Bowen; *Star Scientific, Inc. v. R.J. Reynolds Tobacco Company* AW 01 CV 1504 (2002).

Declaration of Hassel Brown; *Star Scientific, Inc. v. R.J. Reynolds Tobacco Company* AW 01 CV 1504 (2002).

Declaration of Leroy Lynch; *Star Scientific, Inc. v. R.J. Reynolds Tobacco Company* AW 01 CV 1504 (2002).

Declaration of Derrick Hobson, *Star Scientific, Inc. v. R.J. Reynolds Tobacco Company* AW 01 CV 1504 (2002).

Durão et al. "A Numerical Simulation of the Heat Loads in Flue–Curing of Tobacco" *Proceedings of Coresta Symposium:* 1:183–192 (1986).

"The Gold Leaf" The Tobacco Control Board. (1970).

Grise, Verner N. *Trends in Flue–Cured Tobacco Farming* United State Department of Agriculture Jun. (1981).

Hassler, F.J. "Leaf Temperature Measurement in Tobacco Curing Research" *Tobacco Science* 1:64–67 (1957).

Hawks, S.N. *Principles of Flue–Cured Tobacco Production* 2nd Edition 186–209 (1978).

Johnson, "Physical and Biological Relations in the Rapid Drying of Foliar Materials" *Transactions of the ASAE* 11(2):283–290 (1968).

Johnson, William H. "Curing" *Recent Advances in Tobacco Science* (1974).

Johnson, "Rapid Drying of Yellowed Flue–Cured Tobacco" *Tobacco Science* 40:58–68 (1996).

Johnson, "New Processing Methods in the Premanufacturing of Tobacco" *Proceedings of the Fifth International Tobacco Scientific Congress* (1970).

Johnson, "Oxygen Depletion by Respiration for Bright Leaf Tobacco in a Closed Curing System" *Tobacco Science* 9(3)5–11 (1966).

Johnson, W.H. and F. J. Hassler "Carbon Dioxide Liberation and Carbohydrate Accumulation During the Yellowing Phase of Tabacco Curing" *Tobacco Science* 7:85–92 (1963).

MacKown et al., "Tobacco–Specific N–Nitrosamines: Formation During Processing of Midrib and Lamina Fines" *J. Agric. Food. Chem.* 36 1031–1035 (1988).

Mangino et al., "N–Nitrosamines in Beer" *American Chemical Society* 229–245 (1981).

Maw et al., "Radio Controlled Fan Cycling During Bulk Tobacco Curing" *Transactions of the ASAE* 28(2):630–633 (1985).

Maw, et al., "Fan Cycling by Radio Control Device for Tobacco" Presented at the Winter Meeting of the American Society of Agricultural Engineers (1983).
McDowell, et al. "Airflow Rates in Bulk Curing Structures" Presented at the Winter Meeting of the American Society of Agricultural Engineers (1990).
McDowell et al., "Influence of Density and Moisture Loss on Airflow in Bulk Curing Structures" Presented at the Winter Meeting of the American Society of Agricultural Engineers (1990).
Mingwu; "Abstract of Dissertation—The Source And the Regulation of Nitrogen Oxide Production For Tobacco0–Specific Nitrosamine Formation During Air–Curing Tobacco" The Graduate School of the University of Kentucky (1998).
Papenfus et al. "Research on Curing Virginia Tobacco–1972/23" *Tobacco Forum* 11–15 (May 1973).
Peng, Qiyuan, Alkaloids, Nitrates, Nitrites and Tobacco Specific Nitrosamines in Dark Tait, Lyal *Tobacco in Canada* 102–115, 492–499 (1968).
"Tobacco Research" *The Agricultural Foundation, Inc.* North Carolina State College, Raleigh, NC. Aug. (1957).
*Tobacco Information* North Carolina State University, Raleigh, NC. (1989).
Ventobacco Varsos; "Three Tier Barn Assembly Manual" (1992).
Ventobacco; "Bulk Curing Barns Operator's Manual" (Poland 1993).
Ventobacco; "Bulk Curing Barns Operator's Manual" (Jordan 1994).
Ventobacco; "Bulk Curing Barns Operator's Manual" (Turkey 1993).
Ventobacco; Ventolab 6 Operator's Manual (USA 1994).
Ventobacco; "VCU $_{2K}$ Indirect Fired Tobacco Curing Unit with Heat Exchanger and Pressure Burner" (2000).
Watkins; "Using Hot Water for Curing Tobacco" *Tob. Intl.* 182:5 163–165 (1980).
Watkins; R. W. and F. J. Hassler "Effects of Oxygen Stress on Tobacco Discoloration" *Tobacco Science* 6:92–97 (1962).
Whitty, E. B. and T. C. Skinner "Bulk Curing Hints" *Australian Tobacco Growers Bulletin* 18:28–29 (1970).
Yang, C. C. and W. H. Johnson "Indirect Heat Recycling for a Multi–Barn Tobacco Curing System" Presented at the Summer Meeting of the American Society of Agricultural Engineers (1984).
Yamanaka, et al. "Nitrogen Oxide Emissions from Domestic Kerosene–Fired and Gas–Fired Appliances" *Atmospheric Environment* 13:407–412 (1979).
Cui M. et al., TCRC #5074, 1996.
Burton, Harold R. et al., J. Agric. Food Chem., vol. 40, No. 6, pp. 1050–1055 (1992).
Djordjevic, Mirjana V. et al., J. Agric. Food Chem., vol. 37, No. 3, pp. 752–756 (1989).
Legg, P. D. et al., TCRC #4009, 1986.
Chamberlain, W. J. et al., Beitr. Tabak., vol. 15, No. 2, pp. 87–92 (1992).
Peele, D. M. et al., Coresta Bulletin Information, Abstract 9822, p. 146 (1995).
Bush, L. P. et al., Coresta Bulletin Information, Abstract 9814, p. 139 (1995).
Teague R. V., Coresta Bulletin Information, Abstract 9824, p. 148 (1995).
Hamilton et al., Tob. Sci., 26, pp. 133–137 (1982).
Tso, T. C. et al., Beitr. Tabak., 8(1), pp. 34–38 (1975).
Andersen et al., Cancer Research, vol. 45, pp. 5287–5293 (1985).
Larsson, Bonny K. et al., Swedish J. Agric. Sci., 20(2), pp. 49–56 (1990).
Chamberlain, W. J. et al., Tobacco Science, 30, pp. 81–82 (1986).
Bhide, S. V. et al., Beitr. Tabak., vol. 14, No. 1, pp. 29–32 (1987).
Hecht, Chemical Research in Toxicology, vol. 11, No. 6, pp. 559–603 (1998).
Andersen, R. A. et al., IARC Scientific Publications, No. 84, pp. 451–455 (1986).
Tricker, A. R. et al., Cancer Letters, 42, pp. 113–118 (1988).
Chamberlain, W. J. et al., J. Agric. Food Chem., 36, pp. 48–50 (1988).
Peele, D. M. et al., Rec. Adv. Tob. Sci., 21, pp. 81–133 (1995).

TOBACCO PROCESSING

This application is a continuation of U.S. patent application Ser. No. 09/299,403 filed Apr. 26, 1999, now abandoned.

BACKGROUND OF THE INVENTION

The present invention relates to tobacco, and in particular, to the post-harvest treatment of tobacco.

Nitrosamines are known to be present in air, foods, beverages, cosmetics, and even pharmaceuticals. Preussman et al., *Chemical Carcinogens, 2nd Ed, Vol.* 2, Searle (Ed.) ACS Monograph 182, 829–868 (1984). Tobacco and tobacco smoke also are known to contain nitrosamines. Green et al., *Rec. Adv. Tob. Sci.,* 22, 131 (1996). Tobacco is known to contain a class of nitrosamines known as tobacco specific nitrosamines (TSNA). Hecht, *Chem. Res. Toxicol.,* 11(6), 559–603 (1998); Hecht, *Mut. Res.,* 424(1,2), 127–142 (1999). TSNA have been reported to be present in smokeless tobacco, Brunnemann et al., *Canc. Lett.,* 37, 7–16 (1987), Tricker, *Canc. Lett.,* 42, 113–118 (1988), Andersen et al., *Canc. Res.,* 49, 5895–5900 (1989); cigarette smoke, Spiegelhalder et al., *Euro. J. Canc. Prev.,* 5(1), 33–38 (1996); Hoffmann et al., *J. Toxicol. Env. Hlth.,* 50, 307–364 (1997); Borgerding et al., *Food Chem. Toxicol.,* 36, 169–182 (1997); nicotine-containing gum, Osterdahl, *Food Chem. Toxic.,* 28(9), 619–622 (1990); and nicotine-containing transdermal patch, Adlkofer, In: Clarke et al. (Eds.), *Effects of Nicotine on Biological Systems II,* 17–25 (1995).

Green and freshly harvested tobaccos have reported to be virtually free of TSNA. Parsons, *Tob. Sci.,* 30, 81–82 (1986); Spiegelhalder et al., *Euro. J. Canc. Prev.,* 5(1), 33–38 (1996); Brunnemann et al., *J. Toxicol.-Clin. Toxicol.,* 19(6&7), 661–668 (1982–3); Andersen et al., *J. Agric. Food Chem.,* 37(1), 44–50 (1989); Djordjevic et al., *J. Agric. Food Chem.,* 37, 752–756 (1989). However, it has been observed that TSNA form during the post-harvest processing to which tobacco is subjected. Tricker, *Canc. Lett.,* 42, 113–118 (1988); Chamberlain et al., *J. Agric. Food Chem.,* 36, 48–50 (1988). TSNA are recognized as being formed when tobacco alkaloids, such as nicotine, are nitrosated. Hecht, *Chem. Res. Toxicol.,* 11(6), 559–603 (1998). There has been considerable effort expended toward studying the mechanism of formation of TSNA.

Significant efforts have been expended towards studying the mechanism of TSNA formation during tobacco curing, particularly for Burley tobacco. As a result, it has been postulated that TSNA form during the air-curing of Burley tobacco as a result of microbial mediated conversion of nitrate to nitrite, and the subsequent reaction of nitrate-derived chemical species with alkaloids present in the tobacco. Hamilton et al., *Tob. Sci.,* 26, 133–137 (1982); Burton et al., *J. Agric. Food Chem.,* 40, 1050–1055 (1992); Bush et al., *Coresta Bulletin Information,* Abstract 9814 (1995); Wiernik et al., *Rec. Adv. Tob. Sci.,* 21, 39–80 (1995); Cui et al., *TCRC* (1996). It also has been suggested that the mechanism by which TSNA form during the flue-curing of Virginia tobaccos is similar to that mechanism postulated for air-cured Burley tobacco. See, Djordjevic et al., *J. Agric. Food Chem.,* 37, 752–756 (1989) and Peele et al., *Coresta Bulletin Information,* Abstract 9822 (1995). See also, PCT WO 98/05226 and PCT WO 98/58555, and U.S. Pat. No. 5,803,801 to O'Donnell et al.

It has been known practice to cure certain types of tobaccos, particularly specialty tobaccos, using a so-called fire-curing process. Legg et al., *TCRC* (1986). It also has been common practice to flue-cure certain tobaccos, such as Virginia tobaccos, in barns using a so-called flue-curing process. Cooper et al., *VPI Bull.,* 37(6), 3–28 (1939); Brown et al., *Agric. Eng.,* 29(3), 109–111 (1948); Johnson et al., *Tob. Sci.,* 4, 49–55 (1960); Peele et al., *Rec. Adv. Tob. Sci.,* 21, 81–123 (1995). Tobacco leaf is harvested, placed in barns, and subjected to the application of heat. In recent years, it has been common practice, particularly in North America, to cure tobacco using a so-called direct-fire curing technique. Typical direct-fire heating units are powered by propane, and during use, those heating units produce exhaust gases that come into contact with the tobacco being cured. As a result, it is common for tobacco being cured to be exposed to propane combustion products, including nitric oxides that are present in those exhaust gases; and it is not uncommon for tobacco within a curing barn to be exposed to about 0.5 to about 2 kilogram of nitric oxide during a typical curing cycle of about 6 days in duration.

Tobaccos of a particular type that are cured using flue-curing techniques have been reported to provide higher levels of TSNA relative to similar tobaccos of like type that are air-cured. Chamberlain et al., *Beitr. Taobak.,* 15(2), 87–92 (1992). Furthermore, potential relationships between so-called direct-fire heating techniques and the formation of nitrosamines have been investigated in industries outside of the tobacco industry. *IARC Monograph,* 17, 35–47 (1978); Stehlik et al., *Ecotoxicol. Envir. Saf.,* 6, 495–500 (1982); Scanlan et al., In: Loeppky et al. (Eds.) *Nitrosamines and Related N-Nitroso Compounds,* 34–41 (1994). However, direct-fire heating techniques have not always been associated with the formation of nitrosamines. Larsson et al., *Swedish J. Agric. Sci.,* 20(2), 49–56 (1990). In addition, those references have not reported any correlation between contact of tobacco with nitric oxides during curing and levels of TSNA in direct-fire flue-cured tobacco. However, it has been observed that TSNA form during the flue-curing processes commonly employed in the curing of Virginia tobaccos. Peele et al., *Rec. Adv. Tob. Sci.,* 21, 81–123 (1995).

Typically, in North America, tobaccos such as Virginia tobacco are flue-cured using curing barns equipped with direct-fire heating units that burn propane. However, tobacco flue-curing using curing barns equipped with heat exchange units that burn diesel fuel have been employed to a limited degree within North America. Heat exchangers currently are employed to a significant extent outside of North America, particularly where coal and wood are the prominent fuels. Teague et al., *Coresta Bulletin Information,* Abstract 9824 (1995). For example, curing barns equipped with heat exchange units have been employed in countries including Japan, Turkey, Brazil and Zimbabwe. Tobacco curing barns equipped with non-direct-fire heating units, such as heat exchange units, provide for a so-called indirect heating of the tobacco being cured; and as such, when indirect heating techniques are used to flue-cure tobacco, exhaust gases generated by the heat source do not come into contact with that tobacco to any significant degree.

Attempts have been made to reduce the TSNA levels within tobacco. For example, it has been suggested that control of the temperature and moisture during air-curing may have an effect upon lowering TSNA levels within air-cured tobaccos, such as Burley tobacco. See, *IARC Monograph,* 84, 451–455 (1986). It has been proposed to process tobacco to remove TSNA; such as by the manner that is described in U.S. Pat. No. 5,810,020 to Northway et al. It also has been proposed to cure tobacco in conjunction with the application of microwave radiation and high temperature treatment in order to provide a tobacco possessing extremely low TSNA levels. See, PCT WO 98/05226 and PCT WO 98/58555, and U.S. Pat. No. 5,803,801 to O'Donnell et al.

It would be desirable to provide a manner for treating tobacco in order that TSNA levels within that tobacco are provided at very low levels. It would be particularly desirable to provide an efficient and effective manner or method for inhibiting TSNA formation within tobacco during curing, and particularly during flue-curing.

SUMMARY OF THE INVENTION

The present invention relates to the curing of tobacco and cured tobaccos. Of particular interest is a tobacco curing method that provides a suitably cured tobacco that possesses extremely low levels of tobacco specific nitrosamines (TSNA). Preferred tobaccos that are processed in accordance with the present invention are Virginia tobaccos, and the preferred method for curing those tobaccos is the flue-curing method.

In one aspect, the present invention involves flue-curing tobacco under conditions such that the tobacco that is being subjected to cure is subjected to minimal contact with gaseous nitric oxides. Thus, in a preferred embodiment, steps are taken to avoid contact of tobacco being flue-cured with exhaust gases produced by the heating units that provide the source of heat for the flue-curing process. The present invention allows for a method to prevent formation of TSNA during curing, and allows for tobaccos so cured to possess significantly reduced levels of TSNA relative to similar tobaccos similarly cured using direct-fire curing techniques.

In another aspect, the present invention relates to a method for curing tobacco using a tobacco curing barn. The method is carried out for the purpose of providing cured tobacco possessing an extremely low TSNA content. The method involves the steps of: providing green tobacco; placing the green tobacco in the curing barn; subjecting the tobacco to application of heat from a heating source that is not a direct-fire heating source under conditions suitable to cure that tobacco; and avoiding contact of the tobacco during curing with nitric oxide gases, such as those nitric oxide gases that are present in the exhaust gases of direct-fire heating units (e.g., those by products of combustion of propane). Thus, the method involves activities than are purposefully taken to avoid contact with, or exposure to, tobacco being subjected to flue-curing processing steps with nitric oxide gases.

In yet another aspect, the present invention relates to a method for modifying a tobacco curing barn for the purpose of providing conditions suitable for curing tobacco such that resulting cured tobacco obtained from such barn possesses a TSNA content lower than that of similar tobacco cured using that barn prior to such modification. The method involves the steps of: providing a tobacco curing barn equipped with a direct fire heating unit; removing the direct fire heating unit from the barn; equipping the barn with a heating unit that does not provide contact of tobacco within the barn with nitric oxide gases (e.g., as are provided by exhaust gases containing nitric oxide by products of combustion, such as are provided by the combustion of propane) during cure; and equipping the barn such that the barn is operational for tobacco cure.

DETAILED DESCRIPTION OF THE PREFERRED EMBODIMENTS

The tobacco that is cured in accordance with the present invention can vary. Typically, the tobacco that is cured in accordance with the present invention is Virginia tobacco, and that tobacco is subjected to flue-curing conditions. The varieties of Virginia tobacco that can be grown and cured in accordance with the present invention will be readily apparent to those skilled in the art of tobacco growing, harvesting and processing, and tobacco product manufacture. The manner in which Virginia tobacco is grown, harvested and processed is well known. See, Garner, *USDA Bulletin No.* 143, 7–54 (1909); Darkis et at., *Ind Eng. Chem.,* 28, 1214–1223 (1936); Bacon et al., *USDA Tech. Bulletin No.* 1032 (1951); Darkis et al., *Ind Eng. Chem.,* 44, 284–291 (1952); and Bacon et al., *Ind. Eng. Chem.,* 44, 292–309 (1952). See, also, *Flue-Cured Tobacco Information* 1993, N.C. Coop. Ext Serv.; and Peele et al., *Rec. Adv. Tob. Sci.,* 21, 81–123 (1995). Although not strictly necessary, tobaccos that are grown can be selected on the basis of cultivar type and breeding practices, in order to assist in providing tobaccos that, when cured, possess extremely low TSNA levels. Additionally, although not strictly necessary, tobaccos can be grown under agronomic conditions aimed towards providing tobaccos that, when cured, possess extremely low TSNA levels. See, Tso et al., *Beitr. Tabak.,* 8(1), 34–38 (1975); Andersen et al., *Canc. Res.,* 45, 5287–5293 (1985); Chamberlain et al., *Tob. Sci.,* 30, 81–82 (1986); Bhide et al., *Beitr. Tabak.,* 14(1), 29–32 (1987) and Chamberlain et al., *Beitr. Tabak.,* 15(2), 87–92 (1992).

The tobacco that is cured has been harvested. Tobacco that is cured in accordance with the present invention typically is grown under well known and accepted agronomic conditions, and is harvested using known techniques. Such tobacco typically is referred to as green tobacco. Most preferably, the harvested tobacco is adequately ripe or mature. Peele et al., *Rec. Adv. Tob. Sci.,* 21, 81–123 (1995). Ripe or mature tobacco typically requires shorter cure times than does unripe or immature tobacco. Harvested green tobacco typically possesses virtually no, or extremely low levels of, TSNA; and as such, the preferred green tobacco can be characterized being essentially absent of TSNA.

The green tobacco is placed in the curing barn. Typically, the tobacco can be placed within the barn in racks; or in the case of bulk barns, the tobacco can be placed in boxes. The green tobacco can be placed in the barn in a variety of ways, and typically is carried out as a manner of personal preference. As such, there is wide discretion in the particular determination of the amount of tobacco placed within the barn, the packing density of that tobacco within a box, the spacing of the tobacco within the barn, and the location of various tobacco samples within the barn.

The tobacco is subjected to curing conditions. For the flue-curing of Virginia tobaccos, the temperature to which the tobacco is exposed typically is in the range of about 35° C. to about 75° C.; and the time over which the tobacco is exposed to those elevated temperatures usually is at least about 120 hours, but usually is less than about 200 hours. Curing temperatures reported herein are air temperatures that are representative of the average air temperature within the curing barn during curing process steps. Average air temperatures can be taken at one or more points or locations within the curing barn that give an accurate indication of the temperature that the tobacco experiences during curing steps. Typically, Virginia tobacco first is subjected to a yellowing treatment step whereby the tobacco is heated at about 35° C. to about 40° C. for about 24 to about 72 hours, preferably about 36 to about 60 hours; then is subjected to a leaf drying treatment step whereby the tobacco is heated at about 40° C. to about 57° C. for about 48 hours; and then is subjected to a midrib drying treatment step whereby the tobacco is heated at about 57° C. to about 75° C. for about 48 hours. Thus, it is preferred that tobacco processed in accordance with the present invention be cured for a total period of about 5 days to about 8 days, typically about 6 days to about 7 days. Temperatures to which the tobacco is exposed during cure typically do not exceed about 90° C., frequently do not exceed about 85° C., and preferably do not exceed about 80° C. Exposing Virginia tobacco to temperatures above about 70° C. to about 75° C. during curing is not desirable, as exposure of the tobacco to exceedingly high temperatures, even for short periods of time, can have the effect of decreasing the quality of the cured tobacco. Typically, some ambient air preferably is introduced into the barn during the yellowing stage, significantly more ambient air preferably is introduced into the barn during the leaf drying stage, and heated air preferably is recirculated within the barn during midrib drying stage. The relative humidity within the barn during curing varies, and is observed to change during curing. Typically, a relative humidity of about 85 percent is maintained within the curing barn during the yellowing stage, but then is observed to decrease steadily during leaf drying and midrib drying stages.

After the tobacco is exposed to curing conditions, heating is ceased. Typically, the fresh air dampers of the barn are opened in order to allow contact of ambient air with that tobacco. As such, moisture within the ambient air is allowed to moisten the tobacco; and the very dry freshly cured tobacco is rendered not quite so brittle. The cooled tobacco then is taken down, and the tobacco is removed from the curing barn. Cured tobacco is collected, and normally is prepared for sale. After sale, the tobacco typically is de-stemmed in a conventional manner. The tobacco can be stored and aged as is conventional for flue-cured tobacco. Then, the tobacco can be further processed for use in the manufacture of tobacco products. The cured, aged and processed tobacco can be used in a conventional manner for the manufacture of tobacco products, including smoking products such as cigarettes.

The particular curing barn that is used in accordance with the present invention can vary. Exemplary curing barns are of the type described in U.S. Pat. No. 3,937,227 to Azumano; U.S. Pat. No. 4,114,288 to Fowler; U.S. Pat. No. 4,192,323 to Home; U.S. Pat. No. 4,206,554 to Fowler; U.S. Pat. No. 4,247,992 to MacGregor; U.S. Pat. No. 4,424,024 to Wilson et al. and U.S. Pat. No. 5,685,710 to Martinez Sagrera et al.; and Canadian Patent No. 1,026,186. In North America, and particularly in the U.S.A., tobacco curing barns are manufactured and supplied by various companies, including Long Manufacturing Inc., Taylor Manufacturing Company, Powell Manufacturing Company, Tharrington Industries, and DeCloet Ltd. Other curing barns are available throughout the world, and exemplary barns can be provided by Vencon-Varsos of Greece. Tobacco curing barns have been manufactured and operated in traditional manners for many years, and the design, manufacture and use of such barns will be readily apparent to those skilled in the art of tobacco curing.

In one aspect, the process of the present invention involves modifying a curing barn, particularly a curing barn equipped with a direct-fire heating unit. The particular manner in which the curing barn can be modified can vary. Typically, the direct-fire heating unit is removed from the curing barn. The manner of removal can vary. It is possible to physically remove the heating unit from the curing barn. For purposes of the present invention, it also is possible to remove the heating unit by disabling the operation of that unit or by simply not operating that unit during the curing process conditions. However, as a practical matter, and in order to facilitate installation of a different heating unit, it is preferred to physically remove the direct-fire heating unit from the curing barn. In addition, the fan that is associated with the direct-fire burner, and that is used to circulate heated air throughout the barn, can be removed. Most preferably, the fan is physically removed along with the direct-fire burner.

The curing barn is equipped with a heating unit that is not a direct-fire heating unit. In such a manner, when the heating unit is employed, the tobacco being cured does not come into contact with significant amounts of exhaust gases containing combustion products including nitric oxides. The heating unit most preferably does not provide any significant contact of nitric oxide exhaust gases with tobacco that is being cured. Exemplary heating units are electrical heating units and heat exchange units. Exemplary heating units are obtained from Vencon-Varsos of Greece. Other heating units are employed throughout the world, including the U.S.A., and include heat exchange units that are powered by propane fuels, diesel fuel, coal or wood. The selection of an adequate heating unit depends upon the energy requirements to heat and maintain the tobacco to be cured at the desired temperatures, at the desired rates, for the desired periods of time, and the availability of fuel at a reasonable cost. The selection of a particular heating unit, and the manner of its operation, will be apparent to those skilled in the art of tobacco barn design and manufacture, and in the art of tobacco curing. It also is desirable to employ electrical heating units and heat exchange units, because energy is not required to heat the added moisture within the curing barn that results from combustion of fuel used in direct-fire heating units.

The curing barn is equipped such that the barn is operational for tobacco cure. As such, tobacco within such a barn can be efficiently and effectively cured; and efficient use of energy consumption is achieved. Most preferably, the barn is equipped with a fan of appropriate capability to provide adequate circulation of heated air throughout the barn during curing process steps. If desired, the barn can be equipped with a temperature and relative humidity control unit, or a conventional type of temperature control unit can be employed in conjunction with a manually controlled fresh air damper. In addition, it is possible for the barn to be sealed so as to not have significant air leakage, insulated with acceptable insulation, subjected to metal work so as to provide a well-sealed barn that operates properly, or the like. In addition, the burning zones of a heating unit that burns propane or a similar fuel can be equipped with an oxygen ring, and the combustion zone can subjected to exposure to pure oxygen during operation in order that exposure of nitrogen within environmental air to the burning zone is avoided. Furthermore, temperatures within the heating unit itself can be controlled in order that formation of nitric oxide is minimized.

If desired, new tobacco curing barns can be designed and manufactured in order to carry out the present invention. Such barns can be designed to be equipped with heating units that do not have a propensity to cause contact of the tobacco being cured with significant levels of nitric oxide gases.

During cure, steps are taken to avoid contact of gaseous nitric oxides with the tobacco that is being cured. Typically, steps are taken to avoid exposure of the tobacco to gaseous nitric oxides that are the combustion products of the heat sources used in the curing process. For purposes of the present invention, nitric oxides include those chemical species that are products of combustion of direct-fire heating units; and are those normally gaseous chemical species that can interact with alkaloids present in the tobacco being subjected to cure in order to produce TSNA. Exemplary nitric oxides include NO, $N_2O$, $NO_2$, $N_2O_5$ and $N_2O_3$. For most applications, the level of nitric oxides present in the atmosphere within the barn is, on average, not significantly different from that level within the ambient, environmental air in the region surrounding the barn during the cure period; and that level can approximate, or be lower than, that level in the ambient, environmental air. In addition, it is desirable that the level of nitrogen oxides present in the atmosphere with the barn does not, at any time during the cure period, exceed that normally present in non-polluted, ambient, environmental air. It is desirable to ensure that during the curing period, tobacco being cured has the potential to be contacted by less than 0.1 kilogram of nitric oxide, preferably less than 0.01 kilogram of nitric oxide, and most preferably an amount of nitric oxide that is essentially no different than (or even less than) that amount in ambient, environmental air.

Optionally, further steps can be taken to ensure that the nitric oxide level within the curing barn during cure is maintained as low as possible. For example, the curing barn can be equipped with suitable catalytic conversion units, scrubbers, selectively absorbent materials, selective filtration materials, and the like, in order to provide further removal of nitric oxides from the atmosphere within the curing barn during curing stages. It is desirable to employ relatively pure ambient air, as normally non-polluted environmental air typically possesses extremely low (if not undetectable) levels of nitric oxides. It is desirable to prevent exhaust gases from vehicles, heating units, etc. from entering the barn. In this regard, exhaust from heating units can be directed in such a manner so as to not be introduced into the barn, a positive pressure can be maintained in the barn, and reactions of nitrogen in the air within the combustion zone of heating units (which results in the formation of nitric oxides) can be avoided.

Tobaccos cured in accordance with the present invention possess good chemical and physical properties. The tobaccos preferably possess a moisture content that can be considered uniform, and are not overly dry (and hence are suitable for reordering). The physical integrity of the cured tobacco is very good, and the tobaccos are not overly brittle. The tobacco can be further handled and aged in a conventional manner. The tobaccos exhibit a desirable aroma, and possess sugar contents that are in a desirable range (e.g., sugar contents of about 12 to about 20 percent, on a dry weight basis). The smoking quality of such tobaccos is at least comparable to that of similar tobaccos that are cured using traditionally employed curing techniques.

Tobacco cured in accordance with the process of the present invention possesses extremely low TSNA levels. Total TSNA contents are reported as the sum of the levels of N'-nitrosonornicotine (NNN), 4-(N-methylnitrosoamino)-1-(3-pyridyl)-1-butanone (NNK), N'-nitrosoanabasine (NAB) and N'-nitrosoanatabine (NAT); and typically can be determined using the types of analytical procedures described in Risner et al., *Tob. Sci.,* 38, 1–6 (1994). Virginia tobaccos cured in accordance with the present invention usually possess total TSNA levels less than 2 parts per million (ppm), typically less than 1.5 ppm, and frequently less than 1 ppm, based on the dry weight of the cured tobacco. Total TSNA levels even can be below 0.5 ppm, and preferably can be undetectable. Individual NNN levels preferably are less than 0.5 ppm, and can be at levels that are essentially not detectable; and NNK levels preferably are less than 0.5 ppm, and can be at levels that are essentially not detectable. Tobacco cured in accordance with the present invention typically possess total TSNA contents of at least 5 times lower, frequently at least 7 times lower, and preferably at least 10 times lower, than comparable tobacco, comparably cured using the direct-fire curing methods that cause exposure of the tobacco to nitric oxide gases during curing process steps.

The present invention provides several advantages to those personnel desirous of providing processed tobacco for use within the tobacco industry, and particularly for use in cigarette manufacture. As a result, tobaccos that are used traditionally for manufacturing tobacco products can be used. That is, it is not necessary to breed or otherwise genetically alter tobaccos in order to provide tobaccos that, when cured, can have extremely low levels of TSNA. Tobaccos can be grown in traditional manners, and as a result, it is not necessary to alter the manner in which tobacco is grown. Thus, it is possible to grow tobaccos under conventional agronomic conditions, using conventional agronomic techniques (e.g., fertilization types and levels, and using traditional agricultural chemicals and pesticides), and using traditional harvesting techniques.

Tobaccos possessing a wide range of alkaloid and nitrate levels can be cured. That is, it is not necessary to strictly control the composition of the tobacco that is cured. For example, tobacco that is cured or has been cured in accordance with the present invention does not need to be specially bred or processed so as to possess reduced or low alkaloid and/or nitrate levels. However, if desired, it is possible to process tobacco so as to reduce its nitrogen content, including its nitrate content. Thus, it is possible to process tobaccos that are cured in accordance with the present invention in any of a wide variety of known manners and methods. See, for example, U.S. Pat. No. 3,616,801 to Hind; U.S. Pat. No. 3,847,164 to Mattina et al.; U.S. Pat. No. 4,141,117 to Kite et al.; U.S. Pat. No. 4,141,118 to Gellatly et al.; U.S. Pat. No. 4,301,817 to Keritsis; U.S. Pat. No. 4,302,308 to Keritsis; U.S. Pat. No. 4,302,317 to Bokelman; U.S. Pat. No. 4,364,401 to Keritsis; U.S. Pat. No. 4,566,469 to Semp et al.; U.S. Pat. No. 4,651,759 to Uydess; U.S. Pat. No. 4,685,468 to Malik et al.; U.S. Pat. No. 4,941,484 to Clapp et al., and U.S. Pat. No. 5,230,354 to Smith et al.

Tobaccos can be cured without the necessity of special processing steps. Tobaccos can be cured without special pre-drying or rehydrating steps. Tobaccos do not need to be pre-wet prior to curing (and it is desirable that pre-wetting of tobacco prior to curing be avoided). That is, there is no need to pre-treat the tobacco with water, chemicals (e.g., anti-bacterial agents), or the like. No special precautions have to be utilized when re-ordering the tobacco at the completion of the curing stages. Thus, no special over-wetting or special reordering is necessary. Tobaccos do not need to be subjected to special drying processing steps, either prior to or upon completion of curing. Tobacco can be cured without special physical processing. Tobacco leaf can be cured in leaf form, and the leaf does not need to be subjected to any pre-cure cutting or other pre-cure processing. For example, lamina does not need to be removed from stem prior to curing, and the tobacco does not need to be pressed or rolled prior to processing.

Tobaccos can be cured in essentially conventional manners after harvest. There is no need to cure the tobacco at specially selected and controlled periods of time after harvest. As such, it is not necessary to take special care to control time, tobacco moisture level, tobacco physical character, or cell integrity within the tobacco. Using the process of the present invention, the tobacco can be observed during cure; that is, yellowing and drying can be observed and monitored. Normal periods of curing stages, temperature increase ramp rates, and curing completion times can be employed. It is not necessary that there be a special window of time to initiate curing in order to provide cured tobaccos possessing extremely low TSNA levels. Thus, many of the aspects of the art of tobacco curing are maintained and are not significantly effected as a result of the present invention. Thus, the process of the present invention can be readily employed in an essentially traditional manner by those who have had experience in growing and curing tobaccos.

Tobaccos can be cured in traditional manners using conventional equipment, techniques and curing conditions. Cured tobaccos are subjected to curing times, curing temperatures and other curing conditions that are essentially identical to those that have been traditionally used in North America. That is, a virtually one-step curing process can be employed; that is, the tobacco can be cured for a period of about 120 to about 200 hours in an essentially uninterrupted fashion. Tobacco can be cured without unusual interruptions in the curing process (e.g., tobacco can be subjected to heat treatment associated with curing without interruption so as to subject that tobacco to treatment using electromagnetic radiation). In addition, tobacco can be cured without the necessity of interruption for the purpose of making special measurements of the tobacco during cure. Furthermore, there is no necessity to carry out special processing steps during or after the yellowing or browning phases of the curing process. The conditions employed to carry out the present invention provide tobacco of an overall chemical composition, character and smoking quality that is very similar to that of conventionally flue-cured tobaccos.

Tobacco processed in accordance with the present invention can be subjected to irradiation, if desired. However, it is not necessary to subject tobaccos to curing processes that employ expensive irradiation processes or curing conditions that do not provide desirable curing times, temperatures and curing conditions. In addition, it is not necessary to subject the tobacco to treatment with electromagnetic radiation, such as microwave radiation. From a resource standpoint, it is preferred that the tobacco that is processed in accordance with the present invention not be cured in conjunction with microwave radiation processing techniques. In particular, the types of tobacco curing techniques described in PCT WO 98/05226 and PCT WO 98/58555, and U.S. Pat. No. 5,803,801 to O'Donnell et al., in order to provide low TSNA content tobaccos are not necessary, and preferably are avoided, in carrying out the method of the present invention.

Tobacco can be cured using traditional curing techniques and without the necessity of employing special recirculating air modifications. The tobacco does not need to be subjected to special convective heating. The tobacco does not need to be subjected to special heating steps or special types of heating at particular times in the curing process, such as the type of high temperature convective heating steps described in PCT WO 98/58555. It is particularly preferred to avoid subjecting the tobacco being cured, even for extremely short periods of time, to average air temperatures in excess of about 90° C. That is, it is preferable that the tobacco being cured in accordance with the present invention does not experience exposure to temperatures in excess of about 90° C.

Tobaccos can be cured so as to possess extremely low TSNA levels without the necessity of taking significant effort to control conditions associated with the bacterial or microbial mediated formation of TSNA. Thus, it is not necessary to take steps to ensure that the tobacco that is cured possesses a specific nitrate content, and it is not necessary to ensure that the tobacco is not subjected to conditions that may cause nitrate present in the tobacco to be reduced to nitrite. However, in order to ensure that tobaccos cured in accordance with the present invention possess desirably low TSNA levels when those tobaccos are used for the manufacture of tobacco products, steps can be taken (both before and after the curing process steps of the present invention) to ensure that TSNA formation does not occur as a result of other mechanisms (e.g., through natural processes). For example, prior to the curing process steps of the present invention, it is desirable to handle and treat the tobacco in such a manner that potential microbial mediated formation of TSNA is avoided or prevented. Thus, the tobacco can be maintained at suitable temperatures and moisture levels. As another example, cured tobacco can be handled, aged, stored and processed such that TSNA formation is minimized, avoided or prevented. It is known that processing and storage conditions can have an effect upon the formation of TSNA in cured tobacco. See, for example, Andersen et al., *Canc. Res.,* 45, 5287–5293 (1985); Tricker, *Canc. Lett.,* 42, 113–118 (1988); Burton et al., *J. Agric. Food Chem.,* 37, 1372–1377 (1989); Andersen et al., *Canc. Res.,* 49, 5895–5900 (1989) and Djordjevic et al., *TCRC* (1992).

The following examples are provided to further illustrate the present invention, but should not be construed as limiting the scope thereof. Unless otherwise noted, all parts and percentages are by weight; and all levels of TSNA reported in parts per million (ppm) are on a dry weight basis, based on the weight of a moisture free tobacco sample.

EXAMPLE 1

Two 8-rack tobacco curing barns equipped with electrically powered heating units were provided. The heating units each were about 20 kilowatts resistance heaters. About 1,000 pounds of freshly harvested green upper stalk Virginia tobacco was placed in each of those barns. The tobacco in each barn was subjected to curing conditions. During the yellowing phase, the air temperature in each barn was maintained at 35° C. for 48 hours. During the last 24 hours of the yellowing phase, 4 pounds of nitric oxide (obtained from Praxair Distribution Inc., Product No. 2.5-K, 99.5% Nitric Oxide) was introduced into one of the barns at a relatively constant rate. Except for introduction of nitric oxide gases into one of the barns, the tobacco in each barn was allowed to cure under similar curing schedules with respect to temperature and time until the completion of curing. The specifics of each curing schedule are as follows: yellowing stage, 48 total hours at 35° C.; leaf drying stage, 1° C. temperature increase per hour to 49° C., maintenance of temperature at 49° C. for an additional 10 hours, 1° C. temperature increase per hour to 57° C., and maintenance of temperature at 57° C. for an additional 14 hours; midrib drying stage, 1° C. temperature increase per hour to 74° C., followed by maintenance at 74° C. for 31 hours until midribs are dry. Then, the heat was turned off, the doors of the barn were opened, and the tobacco was allowed to reorder as a result of contact with ambient air. The tobacco then was removed from the barns.

After cure was complete, the tobacco from each barn was evaluated for TSNA content using analytical techniques of the type described in Risner et al., *Tob. Sci.,* 38, 1–6 (1994). The cured tobacco that was subjected to contact with the nitric oxide gases exhibited a total TSNA content of about 174 ppm; while the tobacco taken from the other barn exhibited a total TSNA content of about 1 ppm. For this example, total TSNA content is reported as the sum of the levels of NNN, NNK and NAT. Thus, avoidance of contact Virginia tobacco with nitric oxide gases during flue-curing resulted in a cured tobacco that possessed an extremely low level of TSNA.

EXAMPLE 2

Two 8-rack tobacco curing barns equipped with direct fire liquid propane gas heating units were provided. The heating units provided 45,000 BTUs per hour. About 1,000 pounds of freshly harvested green upper stalk Virginia tobacco was placed in each of those barns. The tobacco in each barn was subjected to curing conditions. During the yellowing phase, the air temperature in each barn was maintained at 35° C. for 48 hours. During the last 24 hours of the yellowing phase, 4 pounds of nitric oxide (obtained from Praxair Distribution Inc., Product No. 2.5-K, 99.5% Nitric Oxide) was introduced into one of the barns at a relatively constant rate. Except for introduction of nitric oxide gases into one of the barns, the tobacco in each barn was allowed to cure under similar curing schedules with respect to temperature and time until the completion of curing. The specifics of each curing schedule are as follows: yellowing stage, 48 total hours at 35° C.; leaf drying stage, 1° C. temperature increase per hour to 49° C., maintenance of temperature at 49° C. for an additional 10 hours, 1° C. temperature increase per hour to 57° C., and maintenance of temperature at 57° C. for an additional 14 hours; midrib drying stage, 1° C. temperature increase per hour to 74° C., followed by maintenance at 74° C. for 31 hours until midribs are dry. Then, the heat was turned off, the doors of the barn were opened, and the tobacco was allowed to reorder as a result of contact with ambient air. The tobacco then was removed from the barns.

After cure was complete, the tobacco from each barn was evaluated for TSNA content using analytical techniques of the type described in Example 1. The cured tobacco that was subjected to contact with the nitric oxide gas exhibited a TSNA content (as evidenced by NNN, NNK and NAT) of 107 ppm; while the tobacco taken from the other barn exhibited a TSNA content of 5 ppm. The flue-cured tobacco provided using direct-fire heating techniques possessed a higher level of TSNA than that tobacco cured using the electrically powered heating units and techniques described in Example 1. In addition, Virginia tobacco exposed to nitric oxide gases during flue-curing results in a cured tobacco that possesses an increased level of TSNA.

EXAMPLE 3

A commercial size tobacco curing barn equipped with a heat exchanger that burns diesel fuel was filled with freshly harvested green upper stalk Virginia tobacco. The tobacco in that barn was subjected to tobacco cure under typical yellowing, leaf drying and midrib drying conditions of the type described in Example 1. That is, steps were taken to avoid exposure of the tobacco being cured to nitric oxide gases, and the tobacco was cured in a manner and for the purpose of providing a cured tobacco having an extremely low TSNA content. The flue-cured tobacco removed from that barn was evaluated for TSNA content using analytical techniques of the type described in Example 1. On average, the cured tobacco exhibited a total TSNA content of about 1 ppm.

A commercial size tobacco curing barn equipped with a heat exchanger that burns propane gas was filled with freshly harvested green Virginia tobacco. The tobacco in that barn was subjected to tobacco cure under typical yellowing, leaf drying and midrib drying conditions of the type described in Example 1. That is, steps were taken to avoid exposure of the tobacco being cured to nitric oxide gases, and the tobacco was cured in a manner and for the purpose of providing a cured tobacco having an extremely low TSNA content. The flue-cured tobacco removed from that barn was evaluated for TSNA content using analytical techniques of the type described in Example 1. On average, the cured tobacco exhibited a total TSNA content of that was essentially undetectable.

A commercial size tobacco curing barn equipped with a direct-fire propane gas burner was filled with freshly harvested green upper stalk Virginia tobacco. The tobacco in that barn was subjected to tobacco cure under typical yellowing, leaf drying and midrib drying conditions of the type described in Example 1. That is, no steps were taken to avoid exposure of the tobacco being cured to nitric oxide gases, and the tobacco was cured in a manner not designed to provide a cured tobacco having an extremely low TSNA content. The flue-cured tobacco removed from that barn was evaluated for TSNA content using analytical techniques of the type described in Example 1. On average, the cured tobacco exhibited a TSNA content of about 11 ppm. Thus, Virginia tobacco cured using direct-fire heating techniques (i.e., such that exhaust gases comprising nitric oxide are contacted that tobacco during cure) exhibited a significantly higher TSNA content, relative to those tobacco samples cured using controlled heat exchange techniques.

That which is claimed is:

1. A method for modifying a tobacco curing barn provided with a direct fire heating unit for the purpose of providing conditions suitable for curing tobacco such that resulting cured tobacco obtained from said barn possesses a tobacco-specific nitrosamine content lower than 2 parts per million, the method comprising:

removing the direct fire heating unit from the tobacco barn, providing the tobacco barn with a heating unit that does not generate exhaust gases comprising nitric oxides in a fashion that would cause contact between said nitric oxides and said tobacco within said barn, and further modifying said barn to ensure that the nitric oxide level within the barn during tobacco curing is suppressed to prevent formation of tobacco-specific nitrosamines.

2. The method of claim 1 whereby nitric oxide levels within the barn during curing approximate that of ambient, environmental air surrounding the barn.

3. The method of claim 1 whereby the barn is equipped with a heat exchange unit.

4. The method of claim 1 whereby the barn is equipped with an electrical heating unit.

* * * * *